United States Patent [19]

Weiss et al.

[11] Patent Number: 4,927,091

[45] Date of Patent: May 22, 1990

[54] DEVICE FOR WINDING AND UNWINDING A WEB OF MATERIAL

[75] Inventors: Peter Weiss; Knut Welkers, both of Neuss, Fed. Rep. of Germany

[73] Assignee: Jagenberg Aktiengesellschaft, Dusseldorf, Fed. Rep. of Germany

[21] Appl. No.: 186,336

[22] Filed: Apr. 26, 1988

[30] Foreign Application Priority Data

Apr. 29, 1987 [DE] Fed. Rep. of Germany ..... 3714329

[51] Int. Cl.[5] ..... B65H 19/06; B65H 16/06

[52] U.S. Cl. ..... 242/68.4; 242/58.6; 242/68.7

[58] Field of Search ..... 242/58.6, 66, 67.1 R, 242/68.4, 68.7, 78.7, 79

[56] References Cited

U.S. PATENT DOCUMENTS

| | | | |
|---|---|---|---|
| 2,663,512 | 12/1953 | Erhardt | 242/58.6 |
| 3,806,058 | 4/1974 | Münchbach | 242/58.6 X |
| 4,131,206 | 12/1978 | Kawada et al. | 242/58.6 X |
| 4,265,411 | 5/1981 | Fasolak | 242/58.6 |
| 4,746,076 | 5/1988 | Tomma et al. | 242/68.7 X |

FOREIGN PATENT DOCUMENTS

| | | |
|---|---|---|
| 2951336 | 7/1981 | Fed. Rep. of Germany . |
| 3308271 | 9/1984 | Fed. Rep. of Germany . |
| 3627533 | 2/1986 | Fed. Rep. of Germany . |
| 8511986 | 12/1986 | German Democratic Rep. . |
| 2175572 | 12/1986 | United Kingdom . |

*Primary Examiner*—Stuart S. Levy
*Assistant Examiner*—Steven M. duBois
*Attorney, Agent, or Firm*—Sprung Horn Kramer & Woods

[57] ABSTRACT

A device for winding and unwinding a web of material and including two separated uprights, in each of which is mounted a horizontal chuck onto which the core tube can be introduced. To prevent the core tube from corrugating or tearing, there is a mechanism (15–17) that supports the reel (8) at the bottom during winding and unwinding and that can move along with the reel.

8 Claims, 2 Drawing Sheets

DEVICE FOR WINDING AND UNWINDING A WEB OF MATERIAL

BACKGROUND OF THE INVENTION

The invention concerns a device for winding and unwinding a web of material and having two separated uprights, in each of which is mounted a horizontal chuck that the core tube can be introduced into.

Devices of this type, wherein the reel is tensioned without a shaft between the chucks and secured by them while being wound or unwound, are employed in particular for winding and unwinding webs of paper in the paper-processing industry. Unwinding devices of this type are described for example in German GM 8 511 986 and German OS 2 951 336. Winding devices with these characteristics are disclosed in German OS 3 308 271.

Attempts are always being made in the paper-processing industry to handle increasingly larger and hence heavier reels in order to decrease the downtimes that occur while the reels are being changed. The known winding and unwinding devices, however, can be employed only to wind and unwind reels up to a particular weight, because the core tubes of heavier reels tend to corrugate and tear.

This drawback occurs frequently in the unwinding of heavy reels (60–70 kN) of thin papers with short-diameter core tubes and increases the rate of rejection during subsequent processing of the webs of paper, in salvage winders for example.

SUMMARY OF THE INVENTION

The object of the invention is accordingly to create a device for winding and unwinding reels without a shaft that will allow handling heavy reels without the aforesaid drawback.

This object is attained by an improvement comprising a mechanism (15–17) that supports the reel (8) at the bottom during winding and unwinding and that can move along with the reel.

The mechanism that supports the reel while it is being unwound makes it possible to reduce the stress on the reel in the vicinity of the chucks to the extent that neither corrugations nor tears will occur during winding and unwinding.

These two measures result in a practical combination of a reel-changing mechanism with a supporting mechanism.

BRIEF DESCRIPTION OF THE DRAWING

The invention will now be described with reference to the drawings, wherein.

DETAILED DESCRIPTION OF THE INVENTION

Figure 1:
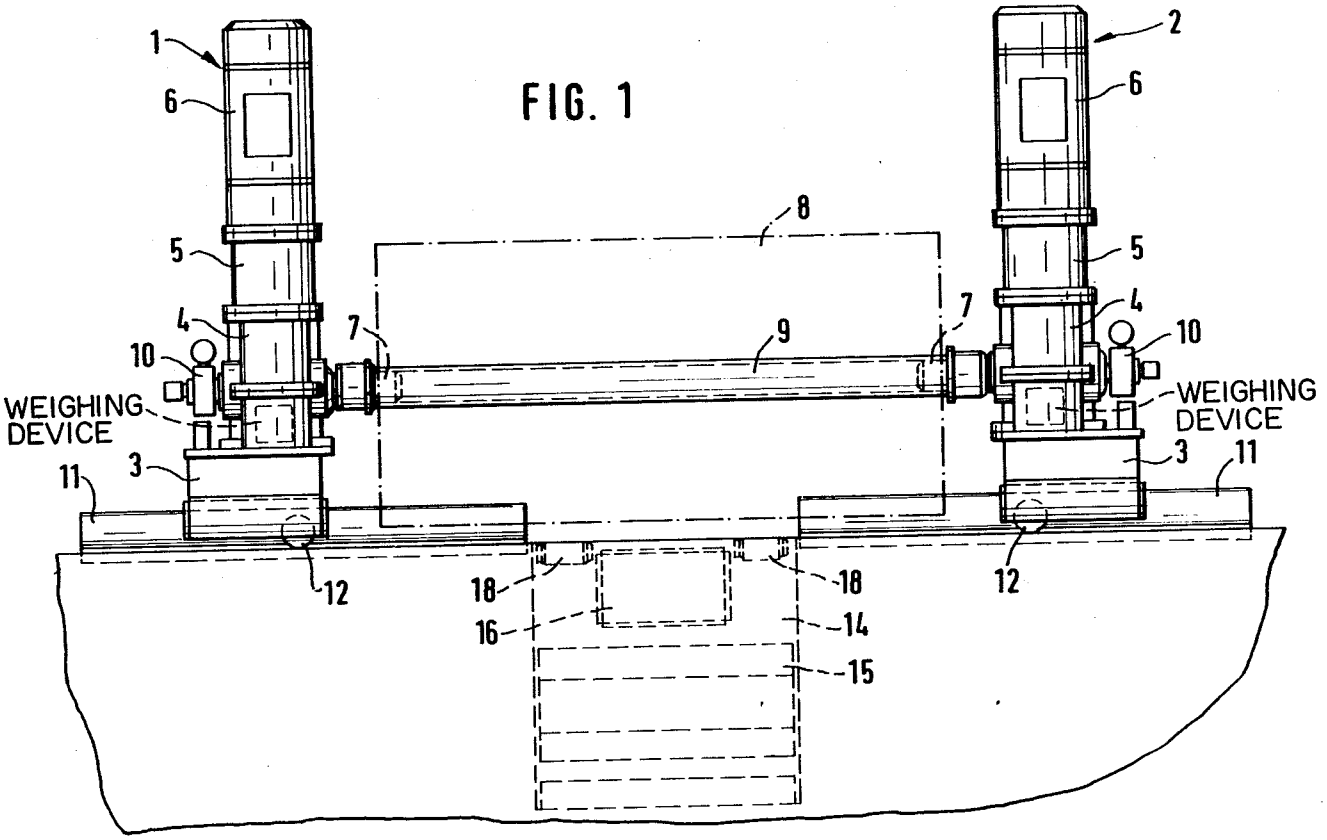
FIG. 1 is a cross-section through an unwinding device in accordance with the invention and FIG. 2 is a side view.
Figure 2:
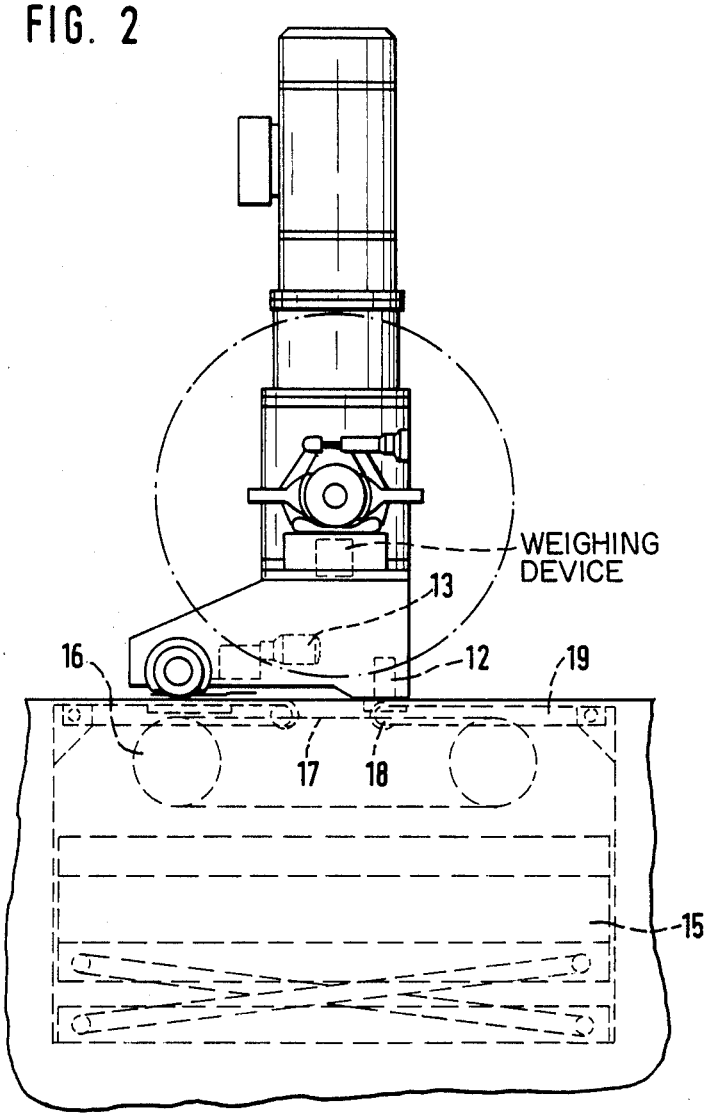

The unwinding device illustrated in the drawing has two uprights 1 and 2, spaced from one another transverse to the direction of web travel. Each upright has a miter gear 4, a coupling 5, and a brake generator 6 mounted on an unwinding stand 3. Mounted on the inside end of the horizontal shaft of each miter gear 4 is a horizontal chuck 7 for engaging the core tube of the reel (supply reel 8) that is to be unwound. At the outer end of the shaft is a retaining brake 10.

Unwinding stands 3 are mounted on a pipe track 11 and on a supporting roll 12 that extends parallel to the direction that the web travels in such a way that they can be moved across the direction in which the web travels. This motion is induced by a rack-and-pinion mechanism 13.

In the middle between unwinding stands 3 and in a recess 14 in the floor is a framework 15 that can be raised and lowered. Positioned within the framework at equal distances from the axis of mounted supply reel 8 and across the direction in which the web travels are two freely rotating pulleys 16. Traveling over the pulleys in a continuous belt 17 with an upper and horizontal section that constitutes a supporting surface. It can be raised above the surface of the floor toward chucks 7 and lowered to below the surface of the floor.

Slightly above supporting belt 17, two alignment rolls 18 are mounted, one on each side facing uprights 1 and 2, on levers 19 on framework 15 in such a way that they can be pivoted down. In the pivoted-up position, alignment rolls 18 are at an equal distance from the axis of mounted supply roll 8. This distance is slightly less than half of the distance of pulleys 16 from that axis.

Instead of with four alignment rolls 18, a fresh supply reel 8 can also be centered with a rigid prism, which must also be lowered by the supporting belt 17 during the weight-relief process.

Secured to the shaft of a supporting roll 12 on one upright 1 or 2 is a wire strain gauge that emits an electric voltage proportional to the flection of and hence to the stress on the shaft. This voltage is employed to adjust the elevation of framework 15 and hence of supporting belt 17. The strain gauge constantly measures the weight on chucks 7.

The weight can also be determined by means of weighing mechanisms integrated into uprights 1 and 2. It is also possible to reduce the weight by means of a computer in accordance with the specific gravity, diameter, and weight of supply reel 8. This approach, however, is more complicated than the system that exploits the flection of the axis of the supporting roll as a parameter.

How a fresh supply reel 8 is introduced will now be described. Uprights 1 and 2 are moved apart until the distance between chucks 7 exceeds the width of the reel. Alignment rolls 18 are pivoted up and framework 15 shifted until they arrive at a position more or less equal to the level of the floor. Reel 8 is positioned on alignment rolls 18, which center it. Framework 15 is raised until reel 8 is high enough for chucks 7 to be moved into core tube 9. Reel 8 is tensioned between chucks 7 and alignment rolls 18 are lowered until belt 17 rests against the bottom of the reel, constituting an upper surface for framework 15.

If the weighing mechanism determines that the supply roll weighs more than 30 kN, the controls will raise framework 15 until, due to the reduction of weight carried out by belt 17, the stress on chucks 7 decreases to that level. Since supporting belt 17 revolves during the unwinding process, it will travel at the same speed as the web. Since, however, due to the decrease in the diameter of the reel during the unwinding process, the bottom of the reel will retreat from belt 17, the stress will increase again. The stress detector will sense the increase in stress at uprights 1 and 22 and the controls will again raise framework 15 until the stress again decreases to 30 kN. This automatic stress relief will continue until the overall weight of the reel drops to below 30 kN. Then, subsequent to a prescribed waiting time, framework 15 will be lowered along with belt 17 and the unwinding process will continue without stress until completion.

The design for a supporting mechanism for a winding device of the type described for example in German OS 3 308 271 is similar. Three reels are described therein as being wound at three winding points. Each winding point has a separate supporting mechanism. The elevation of the supporting components is also controlled in accordance with the stress detected on the chuck associated with each stand. The mechanism for changing full reels can again be combined with the supporting mechanism.

It will be understood that the specification and examples are illustrative but not limitative of the present invention and that other embodiments within the spirit and scope of the invention will suggest themselves to those skilled in the art.

What is claimed is:

1. In a device for winding and unwinding a reel comprising a web of material on a core tube and comprising two separated uprights, in each of which is mounted a horizontal chuck which can engage the core tube, the improvement comprising a mechanism (15–17) that supports the reel (8) at the bottom during winding and unwinding, means for moving the supporting mechanism along with the reel, means for detecting the actual weight of the reel on the chucks and means for raising the supporting mechanism in accordance with the actual weight.

2. A device as claimed in claim 1, wherein the supporting mechanism (15–17) has a supporting surface that rests flat against the bottom of the reel (8).

3. A device as claimed in claim 2, including a mechanism that aligns the reel with and positions it on the chucks (7), means for swinging said mechanism out of the way, a supporting component for said mechanism, a framework in which are mounted the swinging means and the supporting component, and means for raising and lowering the framework.

4. A device as claimed in claim 1, including means for raising and lowering the component (17) of the supporting mechanism (15–17) that engages the reel.

5. A device as claimed in claim 4, wherein the supporting mechanism includes a framework (15) that can be raised and lowered, and a continuous belt (17) that moves freely in the framework.

6. A device as claimed in claim 4, wherein the mechanism includes several alignment rolls (18) that can be swung out of the way and that are positioned separated, above the surface of the supporting component (17), on each side of the axis of a mounted reel, and parallel to its axis.

7. A device as claimed in claim 1, including a supporting roll on which at least one upright is mounted in such a way that it can move transverse to the direction in which the web travels.

8. A device as claimed in claim 7, including a wire strain gauge to measure the flection of the axis of the supporting roll.

* * * * *